US010265596B2

(12) United States Patent
Skala

(10) Patent No.: US 10,265,596 B2
(45) Date of Patent: Apr. 23, 2019

(54) GAME SURFACE WITH TERRACED LEVELS THAT COLLECT THROWN BALLS

(71) Applicant: Theodore Skala, Tampa, FL (US)

(72) Inventor: Theodore Skala, Tampa, FL (US)

( * ) Notice: Subject to any disclaimer, the term of this patent is extended or adjusted under 35 U.S.C. 154(b) by 0 days.

(21) Appl. No.: 15/966,875

(22) Filed: Apr. 30, 2018

(65) Prior Publication Data

US 2019/0009156 A1 Jan. 10, 2019

Related U.S. Application Data

(60) Provisional application No. 62/604,488, filed on Jul. 10, 2017.

(51) Int. Cl.

| | |
|---|---|
| ***A63B 67/06*** | (2006.01) |
| ***A63B 63/08*** | (2006.01) |
| *A63B 102/08* | (2015.01) |

(52) U.S. Cl.

CPC ..... *A63B 67/06* (2013.01); *A63B 63/08* (2013.01); *A63B 2102/08* (2015.10)

(58) Field of Classification Search

CPC ..... A63B 63/00; A63B 67/06

See application file for complete search history.

(56) References Cited

U.S. PATENT DOCUMENTS

| | | | | |
|---|---|---|---|---|
| 1,834,317 | A | 12/1930 | Peccerillo | |
| 1,979,584 | A | 11/1932 | Thompson | |
| 2,050,914 | A * | 8/1936 | Anderson | A63F 9/02 273/317 |
| 2,155,929 | A | 8/1936 | Breitenstein et al. | |
| 4,709,929 | A * | 12/1987 | Mills | A63B 63/08 273/402 |
| 5,056,796 | A * | 10/1991 | Conville | A63B 67/06 273/402 |
| 5,123,656 | A | 6/1992 | Green | |
| 8,387,988 | B2 * | 3/2013 | Van Ness | A63F 3/00214 273/261 |
| 8,662,501 | B1 * | 3/2014 | Perales | A63B 63/08 108/44 |
| 9,248,357 | B2 | 2/2016 | Francis | |
| 2004/0108658 | A1 * | 6/2004 | Bartel | A63B 67/06 273/398 |
| 2008/0042360 | A1 * | 2/2008 | Veikley | A63B 67/06 273/398 |
| 2008/0157476 | A1 * | 7/2008 | Striebel | A63B 63/00 273/402 |
| 2011/0215528 | A1 * | 9/2011 | Conville | A63B 67/06 273/402 |
| 2012/0038108 | A1 * | 2/2012 | McLaughlin, Jr. | A63B 63/08 273/402 |
| 2013/0026713 | A1 * | 1/2013 | Angel | A63B 67/06 273/398 |
| 2015/0115531 | A1 * | 4/2015 | Ali et al. | A63B 63/00 273/398 |
| 2015/0190695 | A1 * | 7/2015 | Bonventre | A63B 67/06 273/400 |
| 2016/0038809 | A1 * | 2/2016 | Rockwell | A63B 67/06 273/401 |

* cited by examiner

*Primary Examiner* — Mark S Graham

(74) *Attorney, Agent, or Firm* — Thomas Stanton, Esq.; Stanton IP Law Firm, P.A.

(57) ABSTRACT

A molded plastic game surface that is a target for table tennis balls pitched by players. Balls may come to rest on one of the multiple terraced levels, roll into the hole on the surface, or roll off of the game surface.

22 Claims, 13 Drawing Sheets

GAME SURFACE WITH TERRACED LEVELS THAT COLLECT THROWN BALLS

RELATED APPLICATIONS

This application is related to and claims priority from U.S. provisional patent application Ser. No. 62/604,488, filed Jul. 10, 2017, entitled Game surface with terraced levels that collect thrown balls, which is hereby incorporated by reference herein for all purposes.

STATEMENT REGARDING FEDERALLY SPONSORED RESEARCH OR DEVELOPMENT

This invention was NOT made with government support.

FIELD OF THE DISCLOSURE

The present invention relates to a game designed to measure the skill to toss a ball onto a distal playing surface.

BACKGROUND

The prior art is replete with games of skill involving pitching an object such as bean bags, washers, coins, balls, horse shoes, pucks and frisbee type objects. These games all test the ability of the player to place the object being thrown into a hole or onto a post. The prior art specifically describes the game called corn hole that challenges players to pitch bags filled with dried corn or plastic pellets onto a playing surface or through a hole on a playing surface that is positioned so it is distal from the player. Another game exists in the prior art called beer pong which challenges players to pitch table tennis balls at targets which are formed in the shape of cups to capture the balls when they land in the cup. Another game exists called shuffleboard, played on a surface having a pitching line which limits the forward motion of the players with respect to the distal end that has prearranged scoring areas. The intent of the game is to position the puck sliding it so that it lands on a scoring position which is distal from the player. The scoring positions have various point values and the object of the game is to score the highest point value and arrive at a terminal value such as 15 or 21 prior to the competitor. The game is complicated by the fact that a player can slide their pucks to land on distal end so that they collide with previously thrown pucks, thus changing the score that would have been recorded at the end of the round of play. There also exists another game which is called bocce where the objective of the game is for the player to throw a ball so that it lands and stays closest to a target ball. The player receives a point for placing their ball closest to the target ball. The game is complicated by the fact that a player can throw their ball to land so that they collide with previously thrown balls or the target ball, thus changing the score that would have been recorded at the end of the round of play.

The issue with the games that are familiar and in the prior art is that no game adequately tests the players pitching skill, hand eye coordination, and strategy of the players.

Based on the existing games there exists a need for a game that combines the various skills and attributes of the games disclosed in the prior art and challenges the players in an easy to use and deploy system which incorporates all the challenges of the prior art games into one game of skill.

Thus, an additional or improved game is needed to provide a means of demonstrating the pitching skill, hand eye coordination, and strategy of the players.

SUMMARY

The present disclosure provides a game and method of playing the game that includes the testing of the players pitching skill, hand eye coordination, and strategy of the players.

In an exemplary embodiment, the invention provides a game surface that acts as a target for balls thrown by players allowing them to score points based on the pitching accuracy and landing position.

Other benefits and advantages of the present disclosure will be appreciated from the following detailed description.

DESCRIPTION OF THE DRAWINGS

Exemplary embodiments of a system and method are shown in the accompanying drawings.

DETAILED DESCRIPTION

Figure 1:
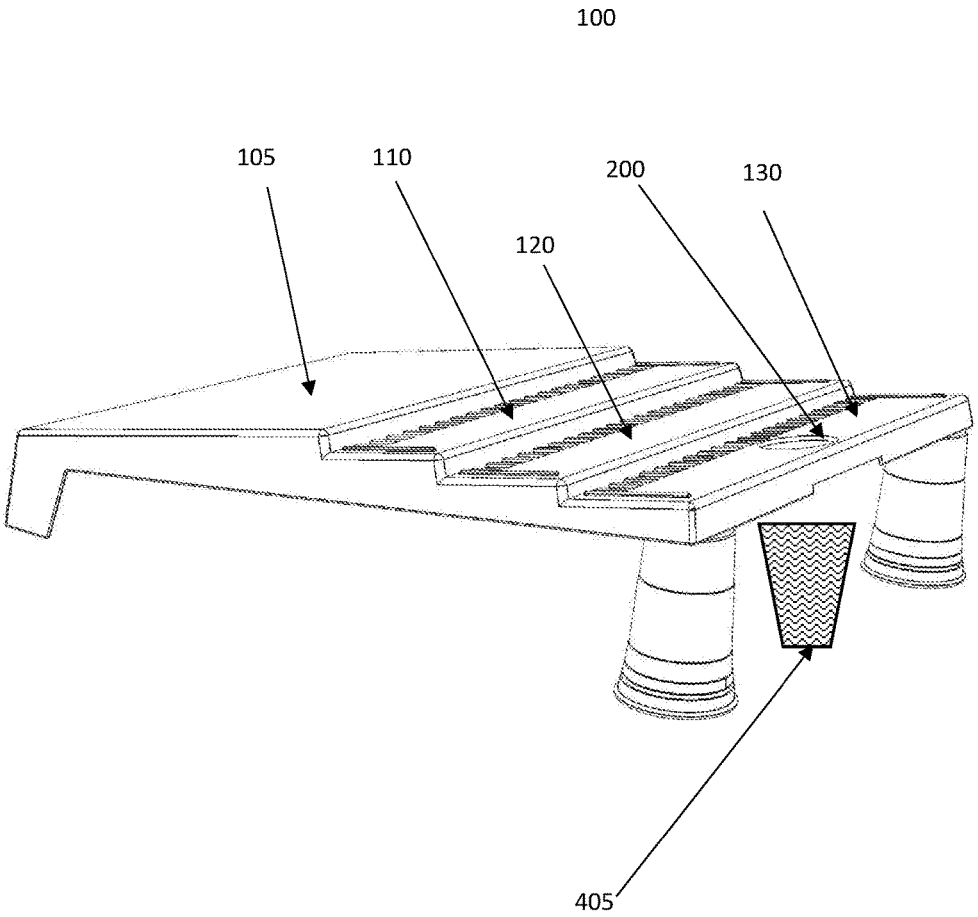
FIG. 1: isometric view of the game playing surface.

Embodiments of the invention and various alternatives are described. Those skilled in the art will recognize, given the teachings herein, that numerous alternatives and equivalents exist which do not depart from the invention. It is therefore intended that the invention not be limited by the description set forth herein or below.

One or more specific embodiments of the system and method will be described below. The described embodiments are only exemplary of the present disclosure. Additionally, in an effort to provide a concise description of these exemplary embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

Further, for clarity and convenience only, and without limitation, the disclosure (including the drawings) sets forth exemplary representations of only certain aspects of events and/or circumstances related to this disclosure. Those skilled in the art will recognize, given the teachings herein, additional such aspects, events and/or circumstances related to this disclosure, e.g., additional elements of the devices described; events occurring related to creation of a flexible and robust game surface. Such aspects related to this disclosure do not depart from the invention, and it is therefore intended that the invention not be limited by the certain aspects set forth of the events and circumstances related to this disclosure.

Turning now to the FIGS. 1-12, the figures show an exemplary game using game surface of the instant invention and how to construct the surface to provide a means of testing the players 300, 301 and 310, 311 pitching skill, hand eye coordination and strategy. FIGS. 1-12 illustrate the game and game playing surface of the instant invention.

The game surface 100 is molded out of plastic or a suitable material capable of supporting a table tennis ball 400. The game surface 100 having from 2 to 6 landing zones. However, the preferred configuration of the game surface has four landing zones referred to as first landing zone 105, second landing zone 110, third landing zone 120 and fourth landing zone 130. Landing zones 130 being the most distal landing zone. Additionally, landing zone 130 has a hole 200 that is positioned between right side 185 and left side 180.

The game surface 100 has at least 3 legs but preferably four with two proximal legs 140 and 240 and two distal legs 141 and 241 which are designed to sit on another surface such as a support table top surface 190 such that legs 140, 240, 141 and 241 are in communication with support table top surface 190. The legs 140, 141, 240, and 241 are configured so that the game surface 100 sits on the support table top surface 190 so that it is at an angle with respect to the support table top surface 190 and the proximal landing zone 105 proximal edge 132 is lower than the distal edge 131 of landing zone 130 with respect to the support table top surface 190. Alternatively, the legs may be adjustable so that the proximal leg(s) can be adjusted downwardly and distal leg(s) can be adjusted upward to change the inclined of the game surface 100. Thereby increasing the challenge of the game for the players 300, 301 and 310, 311.

Figure 5:
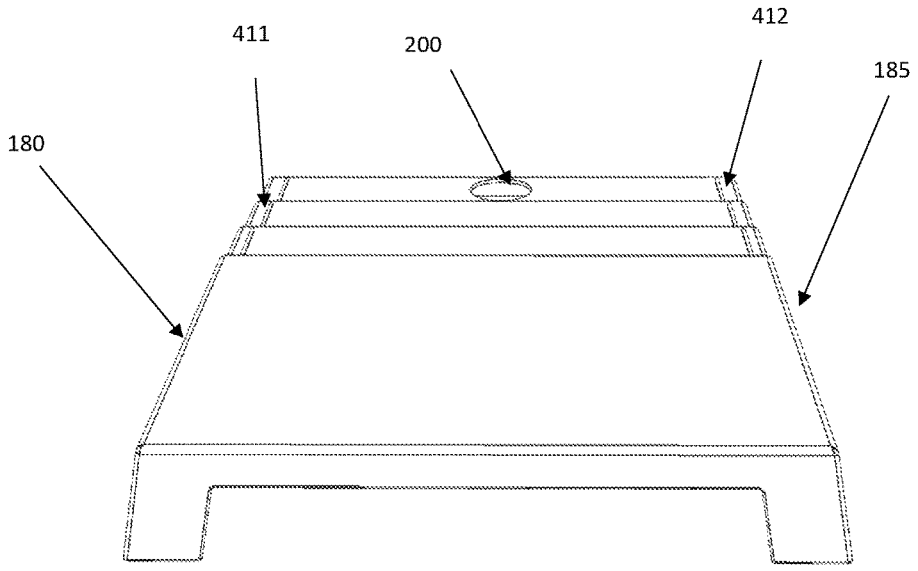
FIG. 5: front view of the game playing surface.
Figure 10:
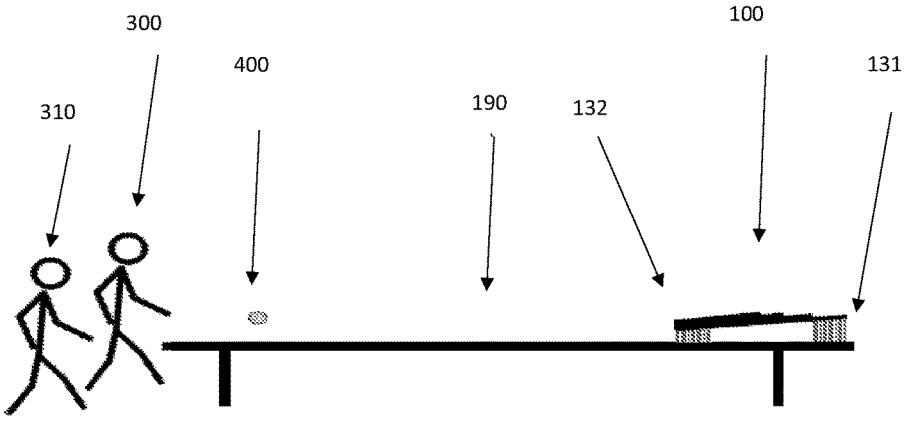
FIG. 10: View of the game being played utilizing one playing surface
Figure 11:
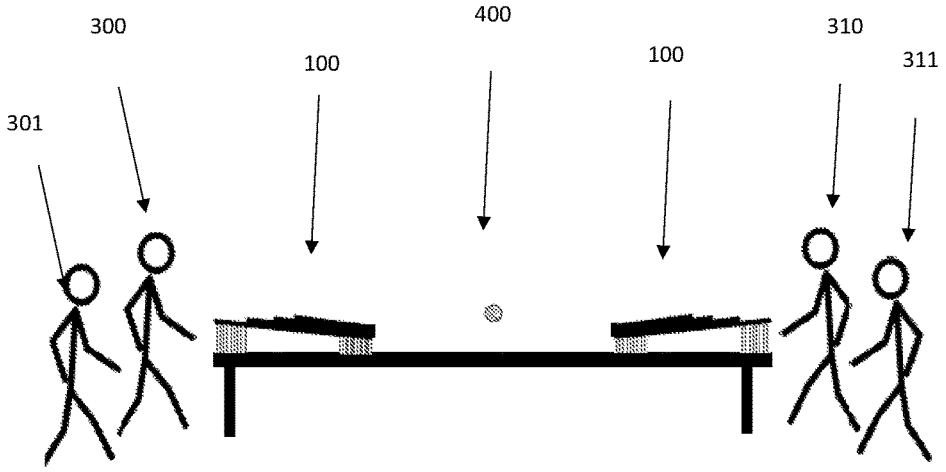
FIG. 11: View of the game being played utilizing two playing surfaces

The support table top surface 190 is ideally substantially wider than the game surface 100. The support table top surface 190 used for the game is preferably 8 feet/2438.4 mm long and 2 feet/608.1 mm wide and the game surface 100 is preferably 1.5 feet/47.2 mm wide and is positioned so that it is centered at the distal end of the support table top surface 190 as shown in FIG. 10 such that the hole 200 is position in the most distal position from the proximal end of support table top surface 190 and centered between right side 195 and left side 197 of support table top surface 190. Hole 200 being sized to allow a table tennis ball 400 to pass through it. The preferable height of the support table top surface 190 is approximate 30 inches/762 mm. Landing zone 105 is approximately 12 inches/304.8 mm in length, landing zone 110 is approximately 4 inches/101.5 mm in length and the proximal edge 111 is approximately 0.25 to 1 inches/6.35/25.4 mm high, landing zone 120 is approximately 4 inches/101.5 mm in length and the proximal edge 121 is approximately 0.25 to 1 inches/6.35/25.4 mm high and landing zones 130 is approximately 4 inches/101.5 mm in length and the proximal edge 133 is approximately 0.25 to 1 inches/6.35/25.4 mm high. The game is played once the game surface 100 is in place at the distal end of the support table top surface 190 and the player(s) players 300, and 310 position themselves at the proximal end of the support table top surface 190. The front of the game surface 100 is 132 and is positioned nearest the player(s) 300 and 310, and back of the game surface 100 is 131 and it is positioned the most distal from the player 300 or 310. FIG. 5 shows what the player(s) 300 and 310 view from his or hers position at the proximal end of support table top surface 190. An optional identical game surface 100 may be placed on the proximal end of the support table top surface 190 as shown in FIG. 11 to allow player(s) 300 and 310 the ability to play from either end of the support table top surface 190. When the game uses support table top surface 190 configured as shown in FIG. 10 then hole 200 of the game surface 100 is positioned so it is distal from the proximal end of support table top surface 190 and players 300 and 310. The game surface 100 are positioned so that it is centered on support table top surface 190 between right side 195 and left side 197. When the support table 190 is configured as shown in FIG. 11 so that up to four players 300, 301 and 310, 311 can play the game from both ends of the table which is the preferred configuration to support more than one player. Then the hole 200 of the first game surface 100 is positioned so it is distal from the hole 200 of the second game surface 100. Both first and second game surface 100 are positioned so that they are centered between support table top surface 190 right side 195 and left side 197.

To play the game in either configuration as shown in FIG. 10 or FIG. 11 up to four players 300, 301 and 310, 311 will take turns similar to players playing the corn hole toss game. The game is usually played such that 2 competing players 300 and 310 always throw from the same side of the table 190 and always throw at the same playing surface 100. If each of these players has a partner, players 301 and 311, both partners stand at the opposite side of the table 190 and throw at a different playing surface 100. The game of the instant invention utilizes from 1 to 10 table tennis balls 400 similar to those described in U.S. Pat. No. 3,942,795 issued to Psenka on Mar. 9, 1976, which is hereby incorporated by reference herein for all purposes. The preferred number of table tennis balls 400 is 4 per player. The table tennis balls 400 are pitched or thrown by the players 300, 301 and 310, 311 at the respective game surface 100 and if they land on the game surface 100 proximal landing zones 105, 110, 120, and 130, they then can bounce and roll forward or off of the game surface 100. If the table tennis ball 400 comes to rest in one of the landing zones 110, 120 and 130 they can be retained by the proximal edges 111, 121, 133 of either landing zone 110, 120, 130. Also, the tennis ball 400 can either land or roll into hole 200. Alternatively, the table tennis ball 400 can roll off of the proximal edge 132, distal edge 131, right side 185 or left side 180 which results in the table tennis ball 400 being out of play.

Figure 2:
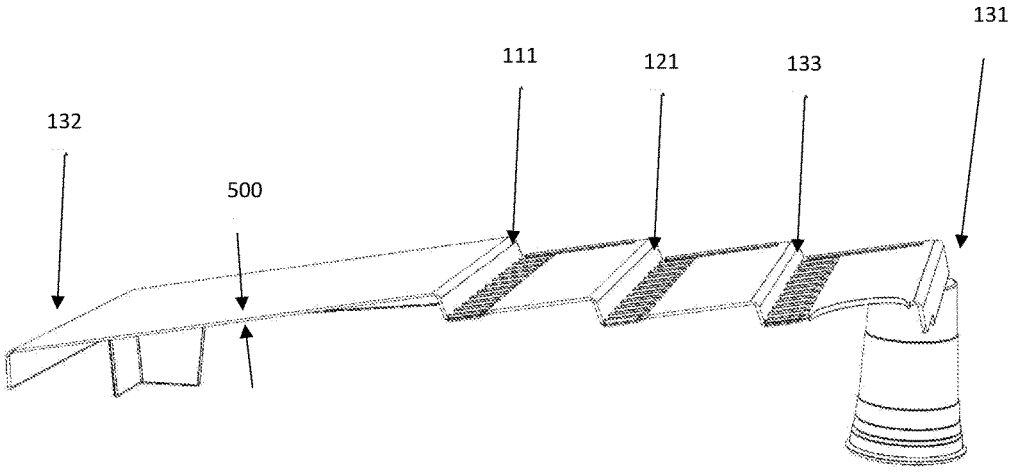
FIG. 2: cross section of the game playing surface.

The plastic material type and thickness of landing surface 100 is designed to minimize the bouncing of the tennis ball 400 by being designed to absorb the shock of the landing ball, so that the forward motion of the table tennis ball 400 is quickly converted from bouncing motion to rolling motion. The thickness of said landing surface 100 is preferably from a minimum of 0.005 inches/0.127 mm to a maximum of 0.25 inches/6.35 mm thick depending on the plastic chosen to make the game surface 100 and is shown on FIG. 2 as cross-sectional thickness 500 of the game surface. FIG. 2 shows that the material used is very thin, in order to absorb the shock/momentum of the ball, so that it bounces very little and allows the ball to roll forward rather than continuing to bounce. Alternatively, the game surface 100 at landing position 105 can be formed from a tightly held cloth or fabric which would minimize the bouncing of the tennis ball 400 when it lands on landing zone 105. The material selection used in the manufacturing of the game surface 100 is also important to control the bounce of the table tennis ball 400. The materials which are suitable for construction of the game surface 100 are wood, nylon, fiberglass, ABS, nylon, Bisphenol-A (BPA), polyvinyl chloride (PVC), Polystyrene, Polypropylene. Additionally, certain plasticizers such as adipates, and phthalates may need to be added to brittle plastics such as polyvinyl chloride.

Figure 4:
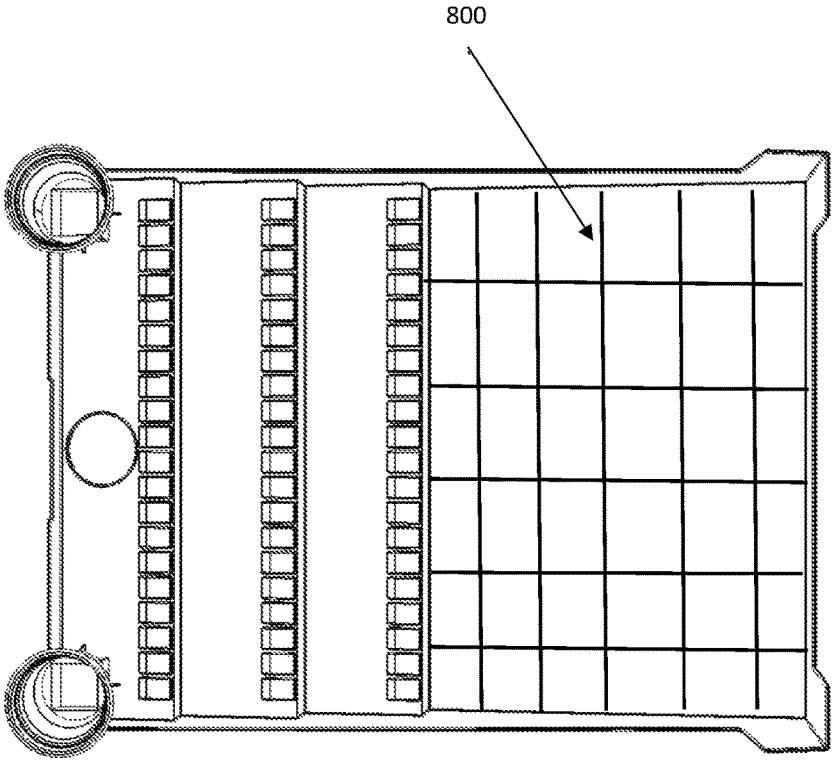
FIG. 4: bottom view of the game playing surface with ribbed lattice.
Figure 4A:
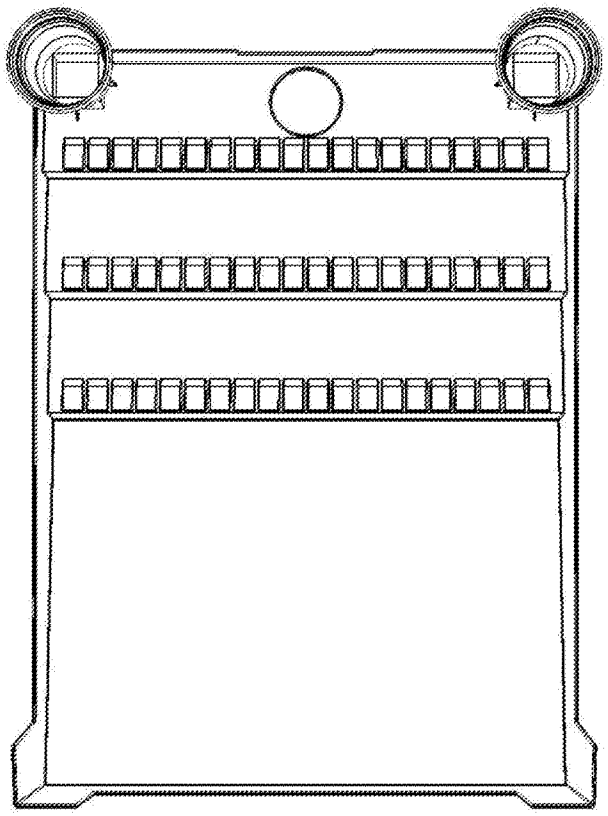
FIG. 4A: bottom view of the game playing surface without ribbed lattice.

FIG. 4 shows the bottom of the game surface 100 and features a ribbed lattice 800 that is designed into the thin molded plastic. This helps to minimize warping of the thin plastic surface during the molding process. FIG. 4A shows an alternate configuration of the bottom of the game surface 100 without ribbed lattice.

Figure 3:
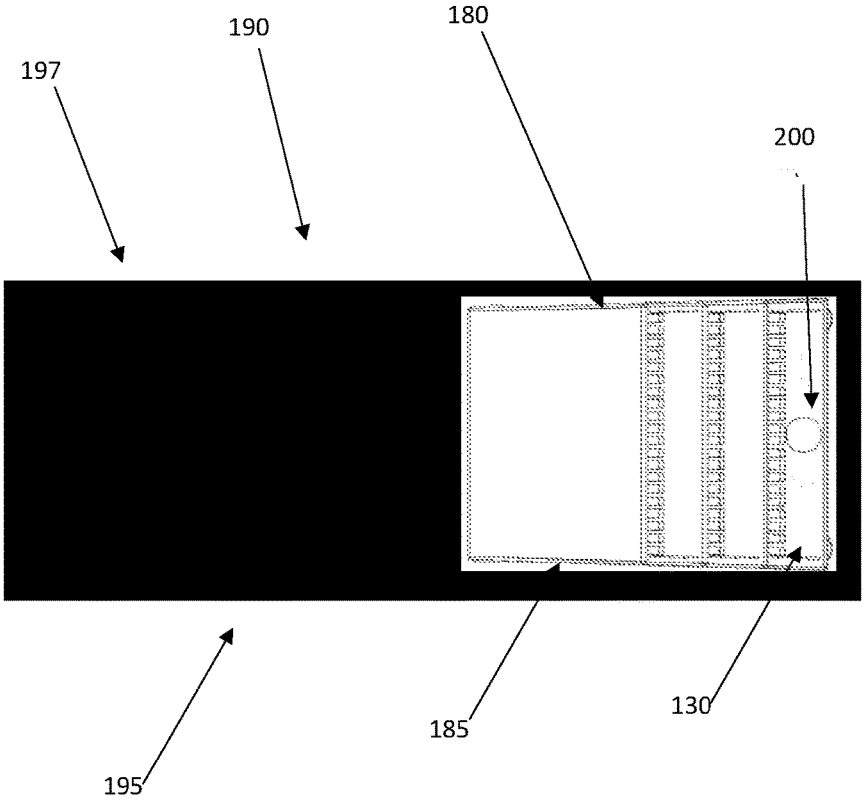
FIG. 3: top view of the game playing surface on a support table.
Figure 6:
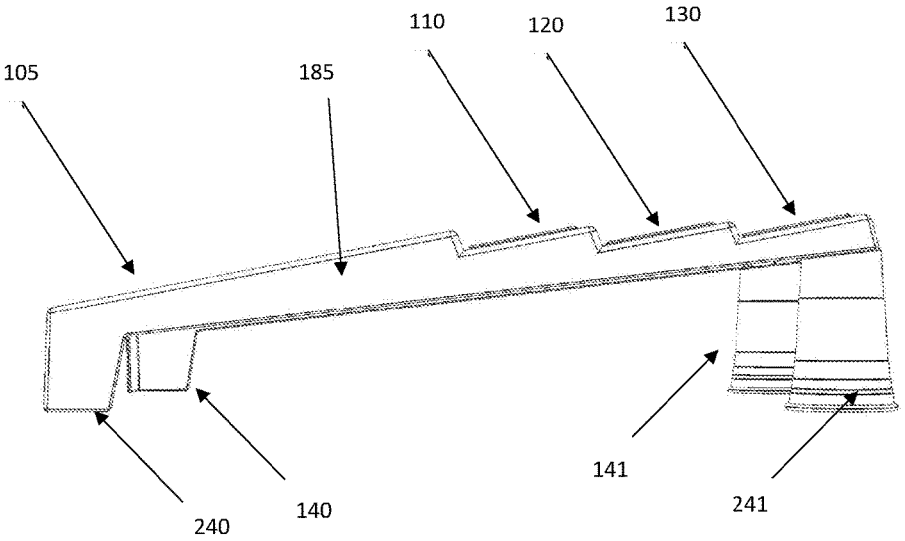
FIG. 6: side view of the game playing surface.
Figure 7:
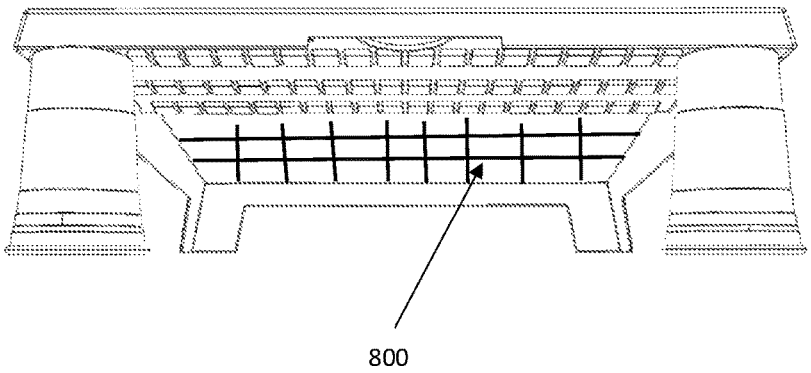
FIG. 7: rear view of the game playing surface
Figure 8:
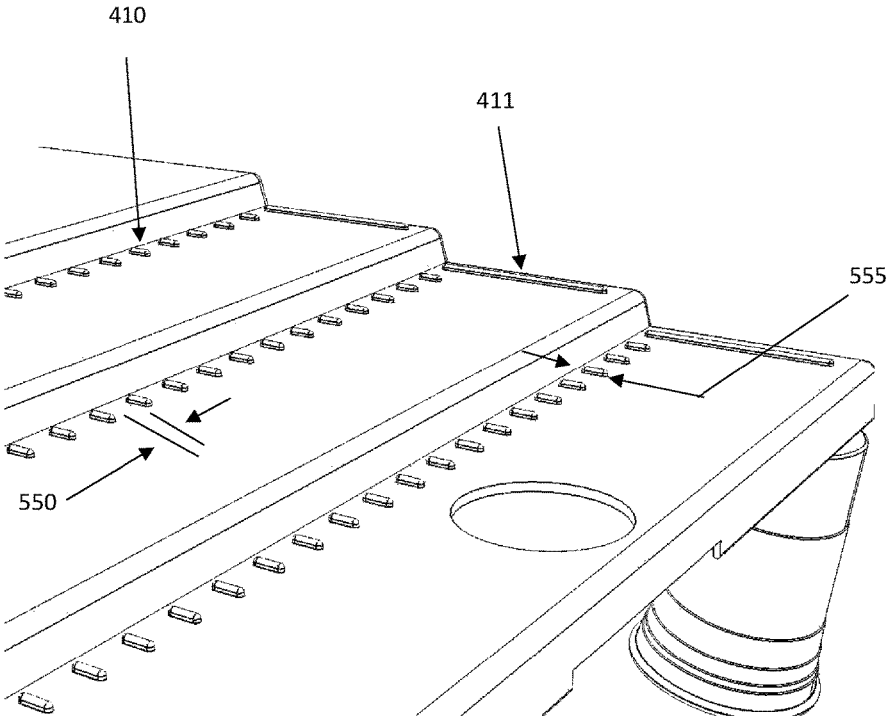
FIG. 8: view showing blisters.
Figure 9:
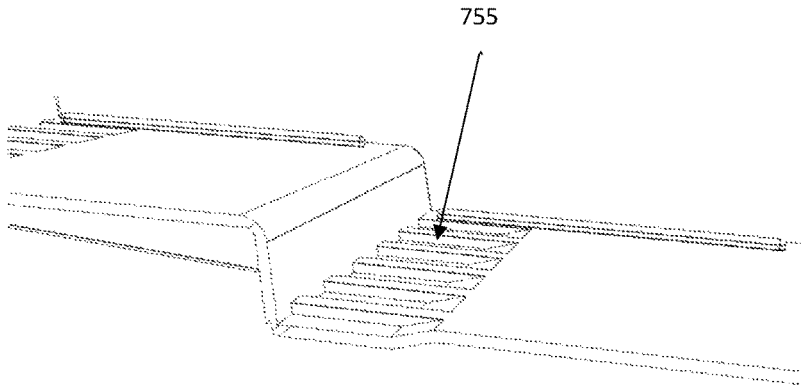
FIG. 9: view showing recessed pockets.
Figure 12:
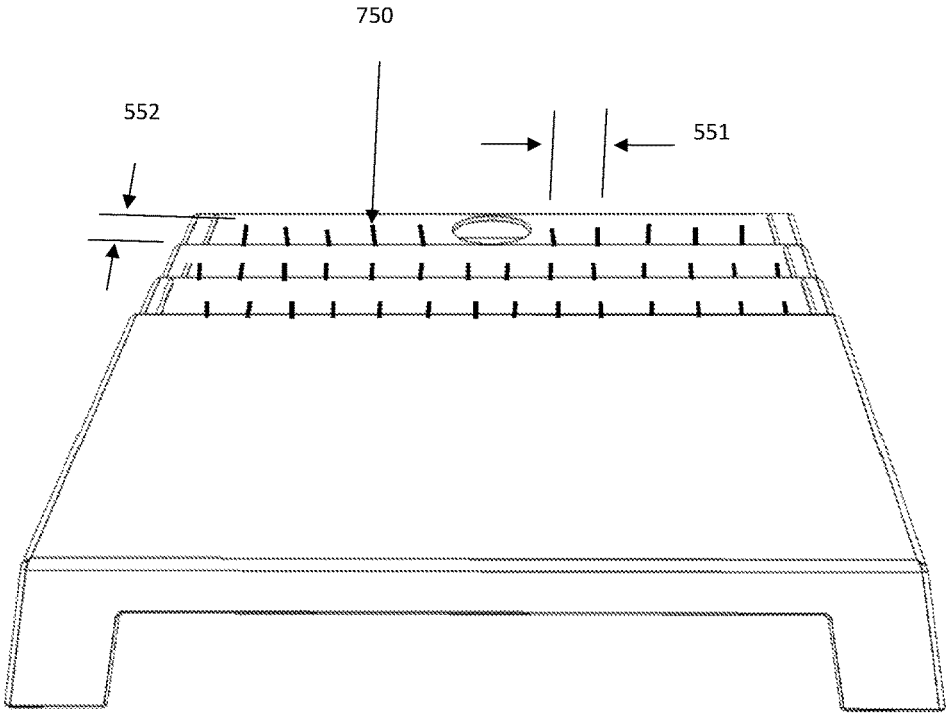
FIG. 12: view showing blisters as raised side walls and flat bottoms even with game surface

FIG. 3 shows hole 200 in the game surface 100 on the landing zones 130 that is distal from the player 300 or 310 when pitching/tossing the table tennis ball 400. When a table tennis ball 400 is pitched/tossed and lands on game surface 100 preferably on landing zone 105 it rolls forward into hole 200 on the surface of landing zone 130 and that table tennis ball 400 is considered "holed". FIG. 6 shows arrangement of the multiple landing zone levels 105, 110, 120 and 130 on the game surface 100 as well as the varying height of the landing zone levels 110, 120, and 130. Landing zone 105 does not have a proximal edge to retain the table tennis ball 400 if it should roll backward towards the pitching player 300 or 310. The lack of a proximal/forward raised proximal edge 132 to capture the table tennis ball 400 at landing zone 105 game surface is designed to test the skill of the players 300, 310 and 301, 311. A table tennis ball 400 ball that lands on landing zone 105 and rolls backwards towards proximal edge 132 can roll off of the landing zone 105 which results in the table tennis ball 400 ball being out of play. Landing zone levels 110, 120, and 130 have a proximal/forward edge 111, 121, and 133 respectively to retain the table tennis ball 400 and prevent table tennis ball 400 from changing levels if it is rolling toward the proximal end of the game surface 100 and the players 300 and 310 that pitched/tossed the table tennis ball 400 towards the game surface 100. Furthermore, the landing zones levels 110, 120, and 130 are structured such that proximal/forward edge 111 is in communication with distal end of landing zone 105 and proximal end of landing zone 110, proximal/forward edge 121 is in communication with distal end of landing zone 110 and proximal end of landing zone 120, proximal/forward edge 133 is in communication with distal end of landing zone 120 and proximal end of landing zone 130. A table tennis ball 400 that comes to rest on one of the landing zone levels 110, 120 and 130 is considered a "captured" ball. A pitched or tossed table tennis ball 400 that is captured on landing zone levels 110, 120 and 130 will encounter retaining features to mitigate the table tennis ball 400 lateral movement so that it will not fall off of the game surface 100 from either right side 185 or left side 180. These retaining features can either be blisters 410, raised blisters 750, or deep pocket blister 755. The retaining features blisters 410, raised blisters 750, or deep pocket blister 755 are designed such that the length, width, and height are suitable to capture a table tennis ball 400. Different blister configurations are used when manufacturing the game surface 100 to increase the difficulty and skill required by the players 300 and 310. Each inner retaining feature blisters type such as blisters 410, raised blisters 750, or deep pockets blister 755 are designed to have a length, height, and a pocket width suitable to capture a table tennis ball 400. The deep pocket blisters 755 are a deeper configuration than blisters 410 as shown in FIG. 9 such that they formed deeper and longer pockets. Blisters 410 which are small lower areas that form small pockets on the game surface of landing zone levels 110, 120, and 130 shown in FIG. 8. The inner retaining features such as the small inner blisters 410 create inner retaining features that form lower areas of the game surface that act as speed bumps to mitigate the table tennis ball 400 lateral movement so that it will not fall off of the game surface 100 from either right side 185 or left side 180. The inner retaining features blisters can alternatively be constructed so that the features are formed by reversing the molding so that the top of the inverted blister 750 retaining features is above the game surface and the pocket formed in the surface is at the same height as the game surface as shown in FIG. 12. Regardless of which of the blister/pocket retaining feature being utilized blisters 410, raised blisters 750, or deep pocket blister 755 on the game surface 100 the inner retaining features blisters 410, raised blisters 750, or deep pocket blister 755 are located on the proximal edge of each landing zone and oriented so they are parallel with right side 185 and left side 180. For blisters 410 and 755 the depth is calculated as a fraction of the depth of the edges 111, 121, and 133 that fraction being from 10 to 50% of the depth of the edges 111, 121, and 133 so that the blister forms a pocket below the game surface and the width 550 of said inner blisters that form inner retaining features is from 0.1 to 1.25 inches/2.54 to 31.75 mm and the length 555 is between 0.25 and 1.5 inches/6.35 to 38.1 mm long. When using blister/pocket retaining feature blisters 410 or deep pocket blister 755, outer blister 411 is parallel with left side 180 and extends the length of the landing zone and forms a raised feature designed to capture the table tennis ball 400 from rolling off of the left side 180 and their height is from 0.1 to 0.5 times the height of edges 111, 121, and 133 and the width of said outer blisters 411 is from 0.05 to 0.25 inches/1.27 to 6.35 mm. Also in this configuration outer blister 412 is parallel with right side 185 and extends the length of the landing zone and forms a raised inner edge to capture the table tennis ball 400 from rolling off of the right side 185 and their height is from 0.1 to 0.5 times the height of edges 111, 121, and 133 and the width of said outer blisters 412 is from 0.05 to 0.25 inches/1.27 to 6.35 mm.

The blisters 750, 755, 410, 411, and 412 are present only on the second, third, and fourth landing zones. The blisters are configured to have a length, height, and a pocket width suitable to capture a table tennis ball 400. The inner retaining features comprising of inner blisters 410, raised blisters 750, or deep pocket blister 755 have the added benefit of limiting the effect of air currents on the table tennis ball 400 that could blow a table tennis ball 400 laterally and off of the game surface 100 so as to fall off of right side 185 or left side 180.

The game can alternatively be configured such that right side 185 and left side 180 have a raised edge similar in height to edges 111, 121, and 133 that would retain the table tennis ball 400 and prevent the tennis ball 400 from falling off of the right side 185 or left side 180.

The blisters 410, raised blisters 750, or deep pocket blister 755 also provide the added benefit of mitigating unwanted lateral table tennis ball 400 movement due to unlevel conditions in the support table 190 that the game surface 100 is resting upon, or unlevel conditions in the molded plastic game surface 100 itself.

As shown in FIG. 12 the blisters can alternatively be constructed so that the features are formed by reversing the molding so that the top of the blister is above the game surface and the pocket is at the same height as the game surface as shown in FIG. 12. The configuration is similar to the pocket formed blisters except that the blisters 750 form raised fences that are located on the proximal edge of each landing zone and oriented in the so they are parallel with right side 185 and left side 180 and the height of each blister can be from 0.1 to 0.5 times the depth of the associated edges 111, 121, and 133 and the width of the feature formed between two raised blisters 750 is dimension 551 which is from 0.05 to 0.25 inches/1.27 to 6.35 mm and the length 552 is between 0.5 and 1.5 inches/12.7 to 38.1 mm long. The thickness of the blisters can be from 0.1 inches to 0.25 inches/2.54 to 6.35 mm. In this configuration, outer blister 411 is parallel with left side 180 and extends the length of the landing zone and forms a raised inner edge to capture the table tennis ball 400 from rolling off of the left side 180 and their height is from 0.1 to 0.5 times the height of edges 111, 121, and 133 and the width of said outer blisters is from 0.05 to 0.25 inches/1.27 to 6.35 mm. Additionally, outer blister 412 is parallel with right side 185 and extends the length of the landing zone and forms a raised inner edge to capture the table tennis ball 400 from rolling off of the right side 185 and their height is from 0.1 to 0.5 times the height of edges 111, 121 and 133 and the width of said outer blisters is from 0.05 to 0.25 inches/1.27 to 6.35 mm.

Using FIG. 11 the game is played as follows, for each round of game play, players 300, 301 and 310, 311. The teams are organized such that team 1 is composed of players 300 and 310 and team 2 is composed of players 301 and 311. Each team has 4 table tennis balls 400 and alternate pitching from each end of the support table 190. Different amounts of points are awarded for captured table tennis balls 400 on either of landing zone levels 110, 120, and 130. For example, a table tennis ball 400 that is captured on landing zone 110 is awarded 0 points, a table tennis ball 400 that is captured on landing zone 120 is awarded 1 point, and a table tennis ball 400 that is captured on landing zone 130 is awarded 2 points. If a table tennis ball 400 lands on landing zone 105 and rolls off of the game surface 100 or if the table tennis ball 400 rolls off of landing zone levels 110, 120, and 130 the player 300, 301, 310, or 311 who pitched the ball is awarded 0 points. Alternatively, if the table tennis balls 400 is holed by entering in hole 200 as shown in FIG. 1 by either rolling into or bouncing the table tennis balls 400 into the hole 200 the player 300, 301, 310, or 311 who pitched the ball is awarded 3 points. Alternatively, the players can agree to various point schemes such as landing zone 110 is awarded 0 points, landing zone 120 is awarded 3 point, landing zone 130 is awarded 5 points, or if holed by entering in hole 200 as shown in FIG. 1 awarding the player 10 points. Therefore, ideally the point schemes are left to the agreement between the players.

Alternatively, the player 300, 301, 310, or 311 who pitched the ball may pitch a table tennis ball 400 at the game surface with the intention of moving one of the captured table tennis balls 400. Points are only calculated at the end of each round when all players 300 and 310 have completed throwing their balls. Rounds of the game continue until one player or team 1 comprising of players 300, 301 or team 2 comprising of players 310 or 311 who pitched the ball reaches a certain threshold of points, usually 21. However, any agreed to terminal number can be used such as 51 or 101. Alternatively, the game surface 100 can include a basket, cup, or container 405 positioned under said hole 200 to catch table tennis ball 400.

It should be understood that the foregoing description is only illustrative of the invention. Various alternatives and modifications can be devised by those skilled in the art having the benefit of this disclosure, without departing from the invention. Accordingly, the invention is intended to embrace all such alternatives, modifications, and variances.

Certain exemplary embodiments of the disclosure may be described. Of course, the embodiments may be modified in form and content, and are not exhaustive, i.e., additional aspects of the disclosure, as well as additional embodiments, will be understood and may be set forth in view of the description herein. Further, while the invention may be susceptible to various modifications and alternative forms, specific embodiments have been shown by way of example in the drawings and will be described in detail herein. However, it should be understood that the invention is not intended to be limited to the particular forms disclosed. Rather, the invention is to cover all modifications, equivalents, and alternatives falling within the spirit and scope of the invention.

What is claimed is:

1. Table game comprising a game surface for use with a support table, said support table having a top surface, distal end and proximal end, said support table having at least one said game surface made from a material capable of supporting a table tennis ball and said game surface mounted on said support table top surface having both proximal legs and distal legs which are in communication with said support table top surface and supports said game surface above said support table top surface, said game surface having a width substantially less than the width of said support table top surface, said proximal legs of said game surface being adjustable downwardly and said distal legs of said game surface being adjustable upwardly such that the said game surface is at an inclination with respect to said support table top surface, said game surface having at least four landing zones such that a most proximal is the first landing zone, the next most proximal is the second landing zone, the next most proximal is the third landing zone, and the most distal is the fourth landing zone and said first landing zone is at the lowest elevation with respect to the said support table top surface and said first landing zone's proximal edge is lower than the said first landing zone's distal edge, and the said second landing zone having a proximal edge that it shares with the first landing zone distal edge such that the second landing zone proximal edge is lower than the first landing zone distal edge, forming a raised edge and said proximal edge of said second landing zone having second outer blisters and second inner retaining features on said surface of said second landing zone parallel to the sides of said game surface and said second outer blisters and said second retaining features having a length, width, and height suitable to capture a table tennis ball, and the said third landing zone having a proximal edge that it shares with the second landing zone distal edge such that the third landing zone proximal edge is lower than the second landing zone distal edge forming a raised edge and said proximal edge of said third landing zone having third outer blisters and third inner retaining features on said surface of said landing third zone parallel to the sides of said game surface and said third outer blisters and said third retaining features having a length, width, and height suitable to capture a table tennis ball, and the said fourth landing zone having a proximal edge that it shares with the third landing zone distal edge such that the fourth landing zone proximal edge is lower than the third landing zone distal edge forming a raised edge and said proximal edge of said fourth landing zone having fourth outer blisters and fourth inner retaining features on said surface of said fourth landing zone parallel to the sides of said game surface and said fourth outer blisters and said fourth retaining features having a length, width, and height suitable to capture a table tennis ball, said fourth landing zone having a hole located in said fourth landing zone capable of passing a table tennis ball through said hole.

2. The table surface of claim 1, wherein said gaming surface material is selected from the group consisting of wood, nylon, fiberglass, ABS, nylon, Bisphenol-A (BPA), polyvinyl chloride (PVC), Polystyrene, and Polypropylene.

3. The table surface of claim 1, wherein said first landing zone has a thickness designed to absorb shock.

4. The table surface of claim 3, where said thickness of said first landing zone is a minimum of 0.005 inches/0.127 mm to a maximum of 0.25 inches/6.35 mm thick.

5. The table surface of claim 1, wherein said fourth landing zone hole is located in the center of said fourth landing zone.

6. The table surface of claim 1, wherein said outer blisters are the length of the landing zone on which they reside.

7. The table surface of claim 1, wherein said inner retaining features length is between 0.25 and 1.5 inches long.

8. The table surface of claim 1, wherein said inner retaining features are selected from the group consisting of a blister, raised blister and deep pocket blister.

9. The table surface of claim 1, wherein the width of said outer blisters is from 0.05 to 0.25 inches.

10. A table game wherein said game surface of claim 1 is played with a table tennis ball such that a player tosses said table tennis ball on any of the landing zone levels and the score awarded to said toss is zero for being captured on said second landing zone, a one for being captured on said third landing zone, a two for being captured on said fourth landing zone and a three for going into said hole on said fourth landing zone.

11. A table game of claim 1 wherein, the support table top surface supports two game surfaces, a first game surface and second game surface, such that said first game surface is placed on said proximal end of said support table top surface such that said first game surface hole is in the most proximal position on the said support table top surface and said second game surface is placed on said distal end of said support table top surface such that said second game surface hole is in the most distal position on the said support table top surface.

12. Table game comprising a game surface for use with a support table, said support table having a top surface, distal end and proximal end, said support table having at least one said game surface made from a material capable of supporting a table tennis ball and said game surface mounted on said support table top surface having both proximal legs and distal legs which are in communication with said support table top surface and supports said game surface above said support table top surface, said game surface having a width substantially less than the width of said support table top surface, said proximal legs of said game surface being shorter than said distal legs of said game surface such that the said game surface is at an inclination with respect to said support table top surface, said game surface having at least four landing zones such that a most proximal is the first landing zone, the next most proximal is the second landing zone, the next most proximal is the third landing zone and the most distal is the fourth landing zone and said first landing zone is at the lowest elevation with respect to the said support table top surface and said first landing zone's proximal edge is lower than the said first landing zone's distal edge, and the said second landing zone having a proximal edge that it shares with the first landing zone distal edge such that the second landing zone proximal edge is lower than the first landing zone distal edge, forming a raised edge and said proximal edge of said second landing zone having outer blisters and inner retaining features on said surface of said second landing zone parallel to the sides of said game surface and said outer blisters and said retaining features having a length, width, and height suitable to capture a table tennis ball, and the said third landing zone having a proximal edge that it shares with the second landing zone distal edge such that the third landing zone proximal edge is lower than the second landing zone distal edge forming a raised edge and said proximal edge of said third landing zone having outer blisters and inner retaining features on said surface of said landing third zone parallel to the sides of said game surface and said outer blisters and said retaining features having a length, width, and height suitable to capture a table tennis ball, and the said fourth landing zone having a proximal edge that it shares with the third landing zone distal edge such that the fourth landing zone proximal edge is lower than the third landing zone distal edge forming a raised edge and said proximal edge of said fourth landing zone having outer blisters and inner retaining features on said surface of said fourth landing zone parallel to the sides of said game surface and said outer blisters and said retaining features having a length, width, and height suitable to capture a table tennis ball, said fourth landing zone having a hole located in said fourth landing zone capable of passing a table tennis ball through said hole.

13. The table surface of claim 12, wherein said gaming surface material is selected from the group consisting of wood, nylon, fiberglass, ABS, nylon, Bisphenol-A (BPA), polyvinyl chloride (PVC), Polystyrene, and Polypropylene.

14. The table surface of claim 12, wherein said first landing zone has a thickness designed to absorb shock.

15. The table surface of claim 14, where said thickness of said first landing zone is a minimum of 0.005 inches/0.127 mm to a maximum of 0.25 inches/6.35 mm thick.

16. The table surface of claim 12, wherein said fourth landing zone hole is located in the center of said fourth landing zone.

17. The table surface of claim 12, wherein said outer blisters are the length of the landing zone on which they reside.

18. The table surface of claim 12, wherein said inner retaining features length is between 0.25 and 1.5 inches long.

19. The table surface of claim 12, wherein said inner retaining features are selected from the group consisting of a blister, raised blister, and deep pocket blister.

20. The table surface of claim 12, wherein the width of said outer blisters is from 0.05 to 0.25 inches.

21. A table game wherein said game surface of claim 12 is played with a table tennis ball such that a player tosses said table tennis ball on any of the landing zone levels and the score awarded to said toss is zero for being captured on said second landing zone, a one for being captured on said third landing zone, a two for being captured on said fourth landing zone, and a three for going into said hole on said fourth landing zone.

22. A table game of claim 12, wherein, the support table top surface supports two game surfaces, a first game surface and second game surface, such that said first game surface is placed on said proximal end of said support table top surface such that said first game surface hole is in the most proximal position on the said support table top surface and said second game surface is placed on said distal end of said support table top surface such that said second game surface hole is in the most distal position on the said support table top surface.

* * * * *